US006289766B1

(12) United States Patent
Sukeshita et al.

(10) Patent No.: US 6,289,766 B1
(45) Date of Patent: Sep. 18, 2001

(54) FOOT-OPERATED PARKING BRAKE

(75) Inventors: Kazumi Sukeshita; Hitoshi Tomura; Yukiyoshi Akutsu; Tetsuya Matsumoto, all of Kanagawa-ken (JP)

(73) Assignees: Nissan Motor Co., Ltd.; Otsuka Koki Co., Ltd., both of Yokohama (JP)

( * ) Notice: Subject to any disclaimer, the term of this patent is extended or adjusted under 35 U.S.C. 154(b) by 0 days.

(21) Appl. No.: 09/464,447

(22) Filed: Dec. 16, 1999

(30) Foreign Application Priority Data

Dec. 17, 1998 (JP) ..... 10-359599

(51) Int. Cl.[7] ..... G05G 5/18

(52) U.S. Cl. ..... 74/576; 74/512; 74/560; 74/575

(58) Field of Search ..... 74/512, 513, 514, 74/560, 575, 576

(56) References Cited

U.S. PATENT DOCUMENTS

| | | | | |
|---|---|---|---|---|
| 2,905,024 | * | 9/1959 | McCarthy et al. | 74/576 |
| 2,938,406 | * | 5/1960 | Rhodes | 74/576 |
| 2,986,046 | * | 5/1961 | Vigmostad | 74/576 |
| 2,995,047 | * | 8/1961 | Hinsey | 74/512 |
| 3,511,107 | * | 5/1970 | Yasiro | 74/512 |
| 3,621,959 | * | 11/1971 | Gale et al. | 74/575 |
| 4,480,802 | * | 11/1984 | Chang et al. | 74/576 |
| 4,850,242 | * | 7/1989 | Hass et al. | 74/575 |
| 5,131,288 | * | 7/1992 | Barlas | 74/512 |
| 5,263,257 | * | 11/1993 | Takigawa | 30/517 |
| 5,318,243 | * | 6/1994 | Hitomi et al. | 74/576 |
| 5,327,797 | * | 7/1994 | Seifrit, Jr. | 74/512 |
| 5,467,666 | * | 11/1995 | Soucie et al. | 74/512 |
| 5,544,925 | * | 8/1996 | Ikeda | 74/576 |
| 5,546,828 | * | 8/1996 | Golarz | 74/512 |
| 5,555,773 | * | 9/1996 | Nanno et al. | 74/512 |
| 5,588,335 | * | 12/1996 | Strait | 74/512 |
| 5,649,453 | * | 7/1997 | Kanbe | 74/512 |

FOREIGN PATENT DOCUMENTS 8-318835 12/1996 (JP) .

* cited by examiner

*Primary Examiner*—David A. Bucci
*Assistant Examiner*—Chong H. Kim
(74) *Attorney, Agent, or Firm*—McDermott, Will & Emery

(57) ABSTRACT

A foot-operated parkin brake apparatus for a vehicle has a base plate, a pedal lever, a sector gear, and a locking pawl. The base plate has a pivot and is fixed with respect to the body of the vehicle. The pedal lever is rotatably supported by the base plate. By stepping on the pedal lever, the parking brake is applied. The sector gear is provided on the pedal lever. The locking pawl has a covering of resin that covers its surface, a bearing hole that is rotatably supported by the pivot of the base plate, and a meshing surface that meshes with the sector gear. The mating surface and the peripheral surface of the bearing hole are exposed metal surfaces which are not covered with the resin. By a meshing between the sector gear and the locking pawl, the pedal lever is locked at the position to which it has been pressed.

14 Claims, 3 Drawing Sheets

FOOT-OPERATED PARKING BRAKE

The content of Application No. TOKUGANHEI 10-359599 which was filed in Japan on Dec. 17, 1998 and on which the claim to priority for this application is based, is hereby incorporated by reference.

BACKGROUND OF THE INVENTION

1. Field of the Invention

The present invention is related to a foot-operated parking brake of a vehicle.

2. Description of the Related Art

In an apparatus disclosed in the Japanese laid-open patent application publication H8-318835, the peripheral surface of a bearing hole formed in a pawl for locking the position of a foot-operating brake level is covered with a resin material.

SUMMARY OF THE INVENTION

In the above related art, when the foot-operated pedal lever is operated so as to apply the parking brake and lock the pedal in place, a high load is applied to the peripheral surface of the bearing hole, thereby resulting in plastic flow of the resin material covering the peripheral surface of the bearing hole, which results in protrusion of the resin material toward the outside, which can interfere with the rotation performance of the locking pawl.

Accordingly, it is an object of the present invention to provide a foot-operated parking brake in which there is no interference with the rotation of the locking pawl, and which features reduced noise when applying and releasing the parking brake.

To achieve the above-noted object, a foot-operated parking brake of the present invention has a base plate, a pedal lever, a sector gear, and a locking pawl. The-base plate has a pivot and is fixed with respect to the body of the vehicle. The pedal lever is rotatably supported by the base plate. The pedal lever is linked to a parking break via a brake cable. By stepping on the pedal lever, the pedal lever rotates, thereby pulling the brake cable, and applying the parking brake. The sector gear is provided on the pedal lever. The locking pawl has a covering of resin covering its surface. The locking pawl has a bearing hole that is rotatably supported by the pivot of the base plate, and a meshing surface that meshes with the sector gear. The mating surface and the peripheral surface of the bearing hole are exposed metal surfaces which are not covered with the resin. By a meshing between the sector gear and the locking pawl, the pedal lever is locked at the position to which it has been pressed.

According to the present invention as described above, because the peripheral surface of the locking pawl is integrally covered by the covering of resin, sliding noise between the locking pawl and the sector gear when the brake is operated and contacting noise and the like between a parking brake release lever and the locking pawl when the brake is released are reduced. Additionally, because the meshing surface of the locking pawl and the peripheral surface of the bearing hole are exposed metal surfaces not covered with resin, when the parking brake is applied, there is a secure meshing between by a metal-to-metal contact between the sector gear and the locking pawl, and the relative position between the pivot and the bearing hole does not change. For this reason, the depressed locked position (parking position) of the pedal lever does not become displaced, thereby avoiding a situation in which the brake fails to hold properly, and in addition interference with the rotation of the locking pawl is eliminated.

DESCRIPTION OF THE PREFERRED EMBODIMENTS

Preferred embodiments of the present invention are described below in detail, with references being made to relevant accompanying drawings.

Figure 1:
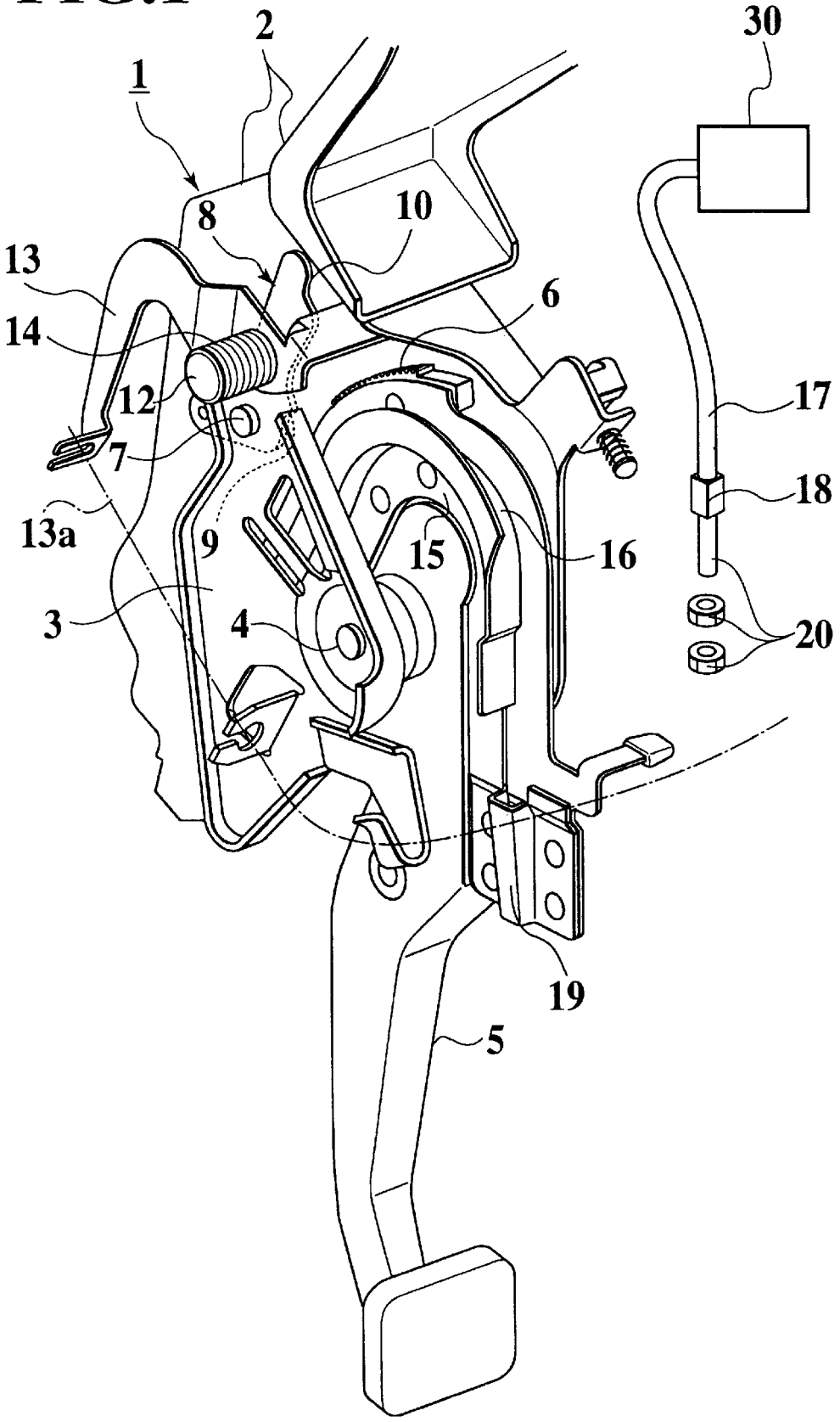
FIG. 1 is a perspective view showing a pedal unit according to the present invention.

As shown in FIG. 1, a pedal unit 1 is fixed to a panel of a vehicle body (not shown in the drawing), with an intervening vehicle-side bracket 2. The pedal unit 1 has a base plate 3 fixed to the bracket 2 and a pedal lever 5 rotatably supported by a pivot 4 on the base plate 3. The pedal lever 5 is impelled by a spring (not shown in the drawing) so as to rotate and return to an initial position. A sector gear 6 is provided on an outer periphery of the pedal lever 5 near the pivot 4. A locking pawl 8 having a finger 9 is rotatably supported to the pivot 7 on the base plate 3. The locking pawl 8 is impelled by a spring (not shown in the drawing) so as to rotate in the direction in which it meshes with the sector gear 6. When the pedal lever 5 is pressed from the initial position, the meshing position between the sector gear 6 and the finger 9 changes, so that the pedal lever 5 is locked in the parking position.

A release lever 13 is rotatably supported at the pivot 12 on the base plate 3 in relation to the locking pawl 8. The release lever 13 is impelled by a set spring 14 so as to rotate in one direction. A release cable 13*a* is connected to one end of the release lever 13. When the release cable 13*a* is pulled in the direction that opposes the force of the set spring 14, the release lever 13 engages with and pushes the contact surface 10 on one end of the locking pawl 8, so that the locking pawl 8 is rotated so as to be released from the sector gear 6. By doing this, the meshing of the finger 9 and the sector gear 6 is released, thereby releasing the pedal lever 5 from its locked condition, placing it in the released condition.

A guide plate 15, which is formed a guide groove 16 for the pedal lever 5, is fixed to the outer surface of the pedal lever 5. The brake cable 17 fits into this cable guide groove 16. The cable end 18 of the brake cable 17 is inserted and mated into a socket part 19 on the pedal lever 5, an adjustment bolt and nut being used to hold it to the socket 19. By pressing on the pedal lever 5, the brake cable 17 is pulled, thereby applying the parking brake 30.

Figure 2:
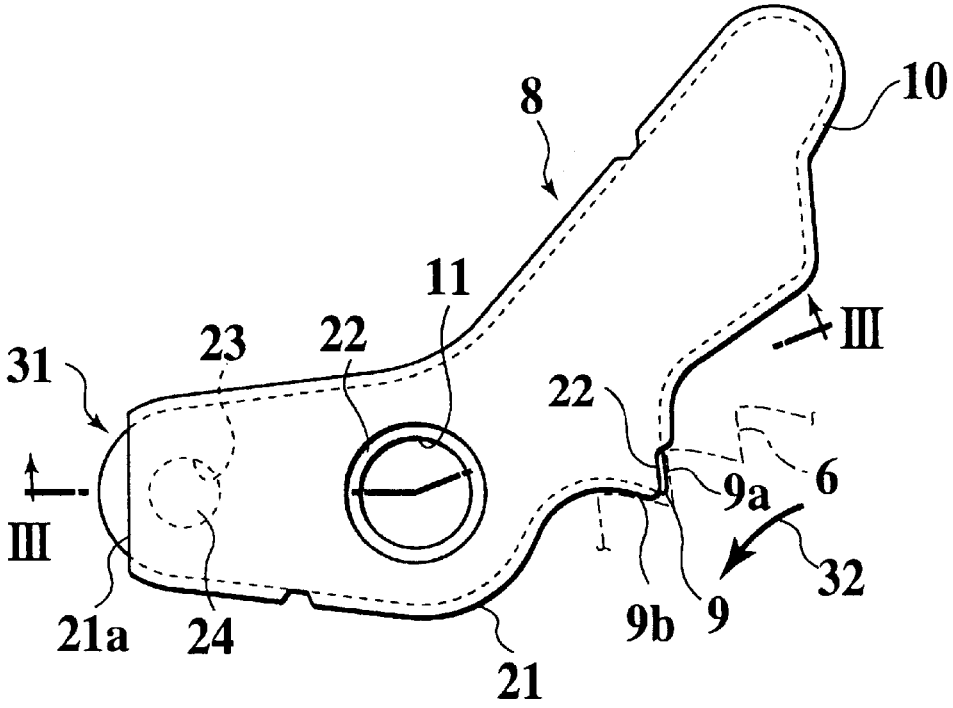
FIG. 2 is a slide view showing the locking pawl of the first embodiment of the present invention.
Figure 3:
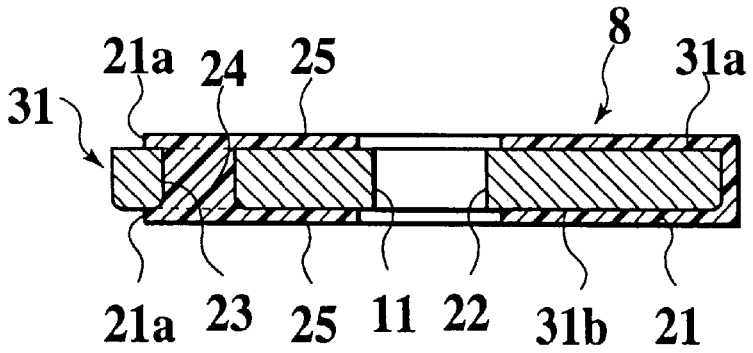
FIG. 3 is a cross-section view along the direction indicated by the line III—III in FIG. 2.

FIG. 2 and FIG. 3 shows an enlarged view of the locking pawl 8 of the first embodiment of the present invention.

The locking pawl 8 is formed by a metal plate 31 and a covering 21 of resin which is integrally formed therewith. Although the covering 21 covers almost the entire surface of the plate 31, the gear surface 9*a* of the finger 9 as a meshing surface meshable with the sector gear 6 and the peripheral surface of the bearing hole 11 that mates with the pivot 7 are metal surfaces 22 that are not covered by the covering 21 of resin.

In this embodiment of the present invention, in order to achieve good melted flowing of resin when the covering 21 is molded, a molding end 21*a* position is provided on the covering 21. More specifically, the molding end 21*a* is the end that is on the opposite side of the surface 10 which contacts the release lever 13, and is established at a position beyond which rotation is prevented.

A through hole 23 is formed in the metal plate 31, passing through the metal plate 31 in the thickness direction. The through hole 23 is disposed between the molding end 21*a* of the covering 21 and the bearing hole 11, and at a position that is near the bearing hole 11. The covering 21 has a pair of side wall parts 25 and a linking part 24. The side wall parts 25 are disposed on both side surfaces 31*a* and 31*b* of the metal plate 31 (the sides in the thickness direction of the locking pawl 8), so as to cover the side surfaces 31*a* and 31*b*.

According the structure of the above-noted embodiment, almost the entire surface of the locking pawl 8 integrally covered by the covering 21 of resin. For this reason, there is a reduction of the sliding noise occurring between the locking pawl 8 and the sector gear 6 when the pedal lever 5 is pressed so as to operate the brake, this being a noise of collision or striking between the sector gear 6 and the rear surface 9*b* of the finger 9, as well as a reduction in the contact noise and the like occurring between the release lever 13 and the locking pawl 8 when the brake is released by operating the brake release.

Because exposed metal surfaces 22 that are not covered by the covering 21 are provided at the gear surface 9*a* of the finger 9 and on the peripheral surface of the bearing hole 11, even if brake operation causes a large load to be applied (in the direction of the arrow 32 in FIG. 2), there is no plastic flow of the covering 21 so as to protrude to the outside from the bearing hole 11, thereby interfering with the rotation of the locking pawl 8, so that good rotation of the locking pawl 8 is maintained.

In this embodiment, the covering 21 (side wall part 25) is formed integrally by the linking part 24 through which the through hole 24 passes in proximity to the bearing hole 11. For this reason, there is improved intimacy of contact between the covering 21 and the metal plate 31, thereby preventing peeling or shifting of the covering 21 with the passage of time, enabling the maintenance of noise reduction over a long period of time.

Figure 4:
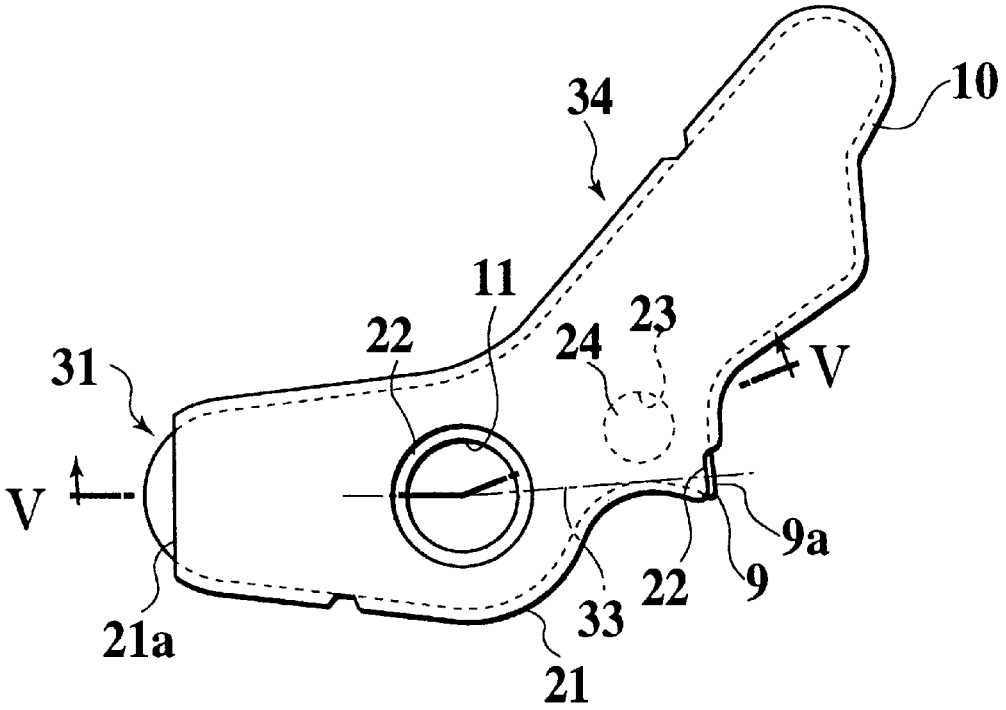
FIG. 4 is a side view showing the locking pawl of the second embodiment of the present invention.
Figure 5:
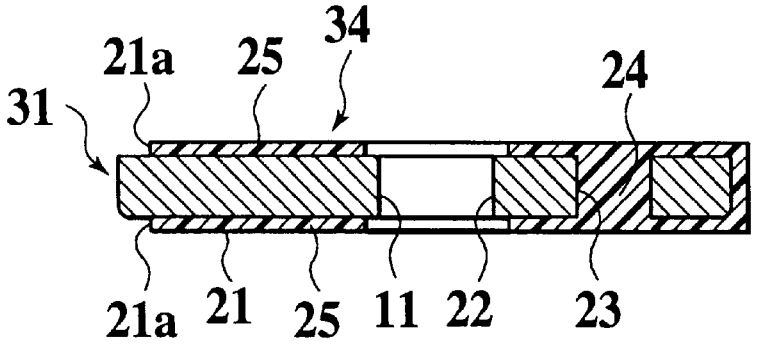
FIG. 5 is a cross-section view along the direction indicated by the line V—V in FIG. 4.

FIG. 4 and FIG. 5 show the second embodiment, which has a locking pawl 34 having a shape that is different from that of the first embodiment. In the second embodiment, the linking part 24 of the first embodiment is provided between the gear surface 9*a* of the finger 9 and the bearing hole 11 and at a position that does not coincide with the load application line 33 which joins the gear surface 9 and the center of the bearing hole 11.

The second embodiment achieves the effect of the first embodiment and also that following additional effect.

Because the a large load acts in the areas surrounding the bearing hole 11 and the gear surface 9*a* when the parking brake 30 is applied, there is a greater tendency for the covering 21 to peel or shift at the border between the exposed metal surface 22 and the surface covered by the covering 21. By providing the linking part 24 between the bearing hole 11 and the gear surface 9*a*, there is improved intimacy of contact between the covering 21 and the areas surrounding the bearing hole 11 and the gear surface 9*a*, thereby more effectively preventing peeling and shifting of the covering 21.

In addition, by providing the linking part 24 at a position that does not coincide with the load application line, which joins the gear surface 9*a* with the bearing hole 11, a reduction in rigidity caused by the formation of the through hole 23 is prevented, thereby improving the rigidity of the locking pawl.

What is claimed is:

1. A foot-operated parking brake apparatus comprising:

a base plate having a pivot and fixed with respect to a vehicle body;

a pedal lever with a sector gear, the pedal lever rotatably supported by the base plate and linked to a parking brake via a brake cable, the pedal lever pulling the brake cable to apply the parking brake when the pedal lever is depressed and rotates; and a locking pawl having a covering of resin integrally formed with a surface thereof, a bearing hole rotatably supported by the pivot of the base plate, and a finger having a meshing surface meshable with the sector gear, wherein a portion of said covering of resin covers at least a portion of the finger except for the meshing surface, wherein the meshing surface and the periphery of the bearing hole have exposed metal surfaces not covered with the resin, wherein meshing between the sector gear and the meshing surface causes locking of the pedal lever at a depressed position, wherein a portion of said covering of resin covers substantially all said finger except for the meshing surface, and wherein said covering covers substantially all of the locking pawl except for the finger meshing surface and the periphery of the bearing hole.

2. A foot-operated parking brake apparatus according to claim 1, wherein the locking pawl has a through hole along a thickness direction thereof, and the covering comprises side wall parts on both sides in the thickness direction of the locking pawl and a linking part that links together the side wall parts via the through hole.

3. A foot-operated parking brake apparatus according to claim 2, wherein the linking part is disposed between the meshing surface and the bearing hole, at a position that does not coincide with a load application line joining the meshing surface and a center of the bearing hole.

4. A foot-operated parking brake apparatus according to claim 2, wherein the linking part is disposed in proximity to the bearing hole.

5. A foot-operated parking brake apparatus according to claim 1, further comprising:

a release lever rotatably supported by the base plate and linked to a release wire, wherein when the release wire is pulled, the release lever is rotated, so that the locking pawl is pushed against the release lever and rotated, thereby moving the meshing surface away from the sector gear and releasing the pedal lever.

6. A foot-operated parking brake apparatus comprising:

a base plate having a pivot and fixed with respect to a vehicle body;

a pedal lever with a sector gear, the pedal lever rotatably supported by the base plate and linked to a parking brake, the parking brake is applied when the pedal lever is depressed and rotates; and a locking pawl having a metal plate and a covering of resin integrally formed therewith, the metal plate having a bearing hole rotatably supported by the pivot of the base plate and a finger having a meshing surface meshable with the sector gear, wherein a portion of said covering of resin covers at least a portion of the finger except for the meshing surface, wherein the meshing surface and the periphery of the bearing hole have exposed metal surfaces not covered with the resin, and wherein meshing between the sector gear and the meshing surface causes locking of the pedal lever at a depressed position, wherein a portion of said covering of resin covers substantially all said finger except for the meshing surface, and wherein said covering covers substantially all of the locking pawl except for the finger meshing surface and the periphery of the bearing hole.

7. A foot-operated parking brake apparatus according to claim 6, wherein the metal plate has a through hole and the covering has side wall parts on both sides of the metal plate and a linking part linking the side wall parts via the through hole.

8. A foot-operated parking brake apparatus according to claim 7, wherein the linking part is disposed between the meshing surface and the bearing hole, at a position that does not coincide with a load application line joining the meshing surface and a center of the bearing hole.

9. A foot-operated parking brake apparatus according to claim 7, wherein the linking part is disposed in proximity to the bearing hole.

10. A foot-operated parking brake apparatus according to claim 6,, wherein the covering covers substantially an entire surface of the metal plate.

11. A foot-operated parking brake apparatus according to claim 6 further comprising:

a release lever rotatably supported by the base plate, when the release lever is rotated, the locking pawl is pushed against the release lever and rotated, thereby moving the meshing surface away from the sector gear and releasing the pedal lever.

12. A foot-operated parking brake apparatus according to claim 2, wherein the linking part comprises resin.

13. A foot-operated parking brake apparatus according to claim 7, wherein the linking part comprises resin.

14. A gear and locking pawl locking system comprising:

a locking pawl rotatably supported about a pivot through a bearing hole formed therein, said locking pawl comprising a finger having a meshing surface and a rear surface;

a gear disposed adjacent said locking pawl, said gear rotatably supported about a pivot through a bearing hole formed therein and said gear further comprising a plurality of gear teeth, each of the gear teeth having a meshing surface and a rear surface, wherein said meshing surface of said finger is configured to matingly engage any of the meshing surfaces of the gear teeth as the gear rotates about said pivot to present one of said plurality of gear teeth to said locking pawl finger meshing surface, wherein said locking pawl comprises a lever configured to selectively engage and disengage said finger with said gear teeth, wherein said locking pawl has a covering of resin formed thereover, wherein the covering covers at least a portion of the finger including the rear surface of the finger, but does not cover the meshing surface and does not cover the periphery of the bearing hole, and wherein meshing between the sector gear and the meshing surface causes locking of the gear and locking pawl system, and wherein said covering covers substantially all of the locking pawl except for the finger meshing surface and the periphery of the bearing hole.

* * * * *